US005379678A

United States Patent [19]

Schulze

[11] Patent Number: 5,379,678

[45] Date of Patent: Jan. 10, 1995

[54] HYDRAULIC DRIVE

[76] Inventor: Eckehart Schulze, Stahlbühlstrasse 36, D-7251 Weissach, Germany

[21] Appl. No.: 946,480

[22] PCT Filed: May 8, 1991

[86] PCT No.: PCT/EP91/00859

§ 371 Date: Nov. 10, 1992

§ 102(e) Date: Nov. 10, 1992

[87] PCT Pub. No.: WO91/18204

PCT Pub. Date: Nov. 28, 1991

[30] Foreign Application Priority Data

May 11, 1990 [DE] Germany ..... 4015101

[51] Int. Cl.[6] ..... F15B 9/03

[52] U.S. Cl. ..... 91/363 R; 91/378; 91/473

[58] Field of Search ..... 91/362, 363 R, 368, 91/374, 375 K, 378, 380, 473

[56] References Cited

U.S. PATENT DOCUMENTS

| | | | |
|---|---|---|---|
| 3,530,764 | 9/1968 | Tomita | 91/380 |
| 4,630,528 | 12/1986 | Eickmann | 91/473 |
| 4,646,621 | 3/1987 | Maruyama et al. | 91/375 R |
| 4,858,650 | 8/1989 | Devaud et al. | 91/375 R |

FOREIGN PATENT DOCUMENTS

| | | | |
|---|---|---|---|
| 1426488 | 3/1969 | Germany . | |
| 18409 | 8/1969 | Japan | 91/363 R |

*Primary Examiner*—Edward K. Look
*Assistant Examiner*—F. Daniel Lopez
*Attorney, Agent, or Firm*—Antonelli, Terry, Stout & Kraus

[57] ABSTRACT

A hydraulic drive in accordance with the invention includes an axial piston hydraulic motor provided for forming a power drive with a follow-up control valve provided for controlling the pressure medium supply with the follow-up control valve being electronically controlled by a desired position value presetting and mechanical actual position value acknowledgement. An electric motor is provided for the desired position value presetting which can be activated by output signals of a central CN or CNC control unit. The rotor of the axial-piston hydraulic motor is rotatably supported with a circular-cylindrical tubular section of an output shaft thereon on an outer casing surface of an axial extension which is a hollow tubular shape and forms a pivot pin for the rotor of a housing section accommodating the electric motor provided for the desired value positioning control.

9 Claims, 2 Drawing Sheets

HYDRAULIC DRIVE

FIELD OF THE INVENTION

The present invention relates to a hydraulic drive and, more particularly, to a rotary or swivel drive for a NC or a CNC controlled machine tool, feeding devices for such machine tools, manipulators, or robots with several rotary or swivel joints.

BACKGROUND OF THE INVENTION

A hydraulic drive of the aforementioned type is disclosed in, for example, German Patent Application P 38 27 365.9–15.

In this drive mechanism, a hydraulic motor designed as an axial-piston motor is provided as the power drive, with a conventional follow-up control valve being included for the motion control, namely, direction of rotation and angular velocity. This valve operates with electrically controllable desired value presetting and mechanical actual value acknowledgment of the indicated dynamic parameters. For desired value introduction, a stepping motor or an AC motor is provided which, in turn, can be activated in accordance with direction of rotation and rotary velocity by output signals of an electronic control unit constituting an output stage of an NC or CNC machine control unit.

The electrical control motor, the follow-up control valve and the axial-piston motor are arranged, in this sequence, along the joint central longitudinal axis of the drive in side-by-side and, respectively, series relationship; feeding of pressure medium takes place to the individual linear cylinders of the axial-piston motor by way of a control cam fixedly mounted to the housing and revolving with the rotor of the axial-piston motor. As seen along the central longitudinal axis, this control cam is arranged "between" the follow-up control valve and the drive section of the hydraulic motor, and the rotor of the hydraulic motor is rotatably supported with its output shaft on a housing end section by two inclined ball bearings in order to obtain a maximally large effective axial length of the bearing, required at the high output power of the hydraulic motor, and yet to make do with small axial dimensions.

The drive mechanism according to the aforementioned patent application is somewhat disadvantageous by virtue of the necessary large total structural length, in spite of these insofar quite suitable structural features and additional aspects, such as the specifically provided type of coupling of the output shaft of the electric control motor, permitting the necessary axial relative motions, to a desired value presetting spindle of the follow-up control valve, and the coupling, accommodated within the rotor shaft, of the actual position value aknowledgment spindle of the follow-up control valve to the rotor of the axial-piston motor. Such length is linked also with relatively large lengths of the liquid columns within the drive mechanism and a concomitant loss of rigidity of the drive unit as a whole.

SUMMARY OF THE INVENTION

It is an object of the invention to improve a hydraulic drive mechanism of the type discussed hereinabove in such a way that it can be realized, with a comparable power density of the drive, with markedly smaller axial dimensions and provides a higher "rigidity" of the drive system as a whole.

In accordance with the present invention, an axial-piston hydraulic motor is provided for forming a power drive means with a follow-up control valve being provided for controlling a pressure medium supply which follow-up control valve is electronically controlled by a desired position value presetting and mechanical actual position value acknowledgement. An electric motor is provided for the desired position value presetting, which motor can be activated by output signals of a central CN or CNC control unit. The rotor of the axial-piston hydraulic motor is rotatably supported with a circular-cylindrical-tubular section of an output shaft thereof on an outer casing surface of an axial extension, being, in turn, fashioned in a hollow-tubular shape and forming a pivot pin for the rotor, of a housing section accommodating the electric motor provided for desired value presetting control.

In accordance with the present invention the follow-up control valve is arranged within the extension, forming the pivot pin for the rotor of the housing section accommodating the electric motor, and control channels through which, during operation of the drive, pressure medium is alternatingly fed and again discharged through the control connections of the follow-up control valve to and from linear cylinders of the rotor arranged in sequence, as viewed in a circumferential direction of the rotor, are formed as sector-shaped outer grooves of the pivot pin, radial transverse channels of the rotor leading to the drive chambers of the linear cylinders of the rotor alternatingly come into congruence with the outer grooves.

By virtue of the provision of the support of the rotor of the hydraulic motor on a pin-shaped extension of the housing section accommodating the electric control motor, this section being, in turn, of a hollow tubular shape and housing the follow-up control valve, which latter is thus arranged coaxially within the drive section of the rotor, a part of otherwise required structural length is saved corresponding its amount approximately to the axial extension of the drive section of the rotor. Also, a radial guidance of the control channels along the shortest path from follow-up control valve to the linear cylinders of the rotor of the axial-piston motor is made possible, having a favorable effect on the rigidity of the hydraulic columns.

In accordance with further features of the present invention, the control connections of the follow-up control valve are connected respectively with one outer annular groove of the housing of the follow-up control valve which, as viewed in an axial direction, are arranged in direct juxtaposition in such a manner that a central plane of the intermediate web separating these two grooves is congruent with the joint central plane of the sector-shaped control grooves, and that two annular grooves are connected alternatingly through a short obliquely extending transverse bore with control curves.

By virtue of the arrangement and design of the pressure-medium-conducting transverse channels and regulating grooves of the tubular pin, it is especially advantageous for this purpose, by way of which the hydraulic connection of the follow-up control valve to the drive chambers of the linear cylinders of the rotor is achieved along the shortest path.

The drive according to the present invention is suitable, due to its compact structure, with special advantage at a joint drive means for a multiple-jointed robot arm comprising several drive means of this type, for example, an arrangement wherein the supply connections of the follow-up control valve are connected to transverse bores of the valve housing, with such bores terminating in transverse channels of the pivot pin which, as viewed in a circumferential direction of the valve housing, are arranged in an offset fashion and are connected by correspondingly offset longitudinal channels with connecting nipples arranged at the housing section forming the pivot pin. One of these transverse channels preferably terminates into an inner groove of the tubular-cylindrical section of the rotor shaft of the axial-piston hydraulic motor, which section coaxially surrounds the pivot pin, and the other transverse channel terminates into an outer groove of the pivot pin. A transverse channel of the rotor shaft ends in the upper groove and is located between the inner groove and the end of the rotor shaft on an output side. The respective supply connection channels extend from the inner groove of the rotor shaft and the transverse channel thereof to the end of the rotor shaft on the output side.

By virtue of the last mentioned features of the present invention, a particularly favorable guidance of the pressure supply lines, via the rotor of the respective drive mechanisms is provided wherein there is no need for flexible hose-type pressure medium conduits.

Even if in a hydraulic drive system controlled by way of a follow-up control valve operating with mechanical actual value acknowledgment, the deviation of an actual position value from the introduced desired position value will drop below a tolerable value, at least after a time span which can be taken into account as an empirical value, it is yet of advantage in order to be able to exploit the good dynamic properties of the drive mechanism, to close the entire positioning control circuit. For this purpose, according to the present invention, a pickup system is provided producing electrical output signals characteristic for incremental changes of the angular position of the rotor of the axial-piston hydraulic motor in accordance with an amount and change of direction, the central electronic control unit provides the desired position value, that is, the actual position value as compared to the processing of the output signals. By virtue of the last noted features an electronic pickup system is provided which produces output signals characteristic of changes of the actual value of the rotary or angular position of the rotor and direction of change, with these output signals being evaluated in a central control unit. According to further advantageous features of the present invention, a locking device is provided which brings about, in case of a drop in the output pressure which brings about, in case of a drop in the output pressure of the pressure supply unit, an automatic arresting of a rotor of the axial-piston hydraulic motor. With the drive having a locking device a special advantage is obtained considering usage in multiple-jointed robot arms, with the locking device automatically bringing about an arrest of the rotor upon cutoff or in case of failure of pressure supply, whereby an effective preventive feature is included minimizing injuries to persons located in the range of the robot arm as well as against damage to components.

The locking device may, in accordance with the present invention include spring-loaded plungers provided as operating elements which are urged by a pretensioned spring, into a position providing for the arresting of the rotor and are connected with pistons defining, in a pressure-tight movable-fashion control chambers, and with the plungers being maintained in a release position effecting release of the rotor by exposing the chambers to the action of the outlet pressure of a pressure supply unit functionally reliable fashion by operating elements as embodied by the features of claim 6, in a simple manner.

According to the present invention operating elements are arranged in an axially symmetrical grouping around a central longitudinal axis of the drive, with plungers of the operating elements being displaceable in parallel to a central longitudinal axis of the drive and acting on an axially movable brake element. The several operating elements can be displaced in parallel to a central longitudinal axis of the drive, then operating elements can act on a locking element that can be urged against an end face of the rotor, the latter being this case suitably mounted to be axially fixed. Alternatively, the motor may be supported to be axially displaceable and may be urged with a brake surface extending over a peripheral range of 360° into frictional contact with a counter surface fixedly provided at the housing. These operating elements can act directly on an axially displaceably rotor of the hydraulic motor.

Additional details and features can be seen from the following description of a specific embodiment with reference to the drawings.

BRIEF DESCRIPTION OF THE DRAWINGS:

As shown in FIG. 1, a hydraulic drive 10 is provided which is suitable for a plurality of applications in mechanical engineering application wherein rotational drive units of high power density are required which can be controlled in a simple way and also can be monitored with great accuracy with regard to the number of performed revolutions of the output element 11 of the drive 10. The accuracy of such monitoring activity is to be possible also within each single revolution of those executed by the output element 11 with a defined angular resolution, for example with a high angular resolution of 0.1°, if necessary even more accurately, wherein this accuracy is essentially dependent on the properties of a pickup system 12. By the pickup system 12, it is possible to pick up the number of revolutions executed by the output element 11 of the drive 10, as well as also, within each individual revolution, the angular position of the output element 11 with regard to a fixedly predetermined reference plane or orientation.

Figure 1:
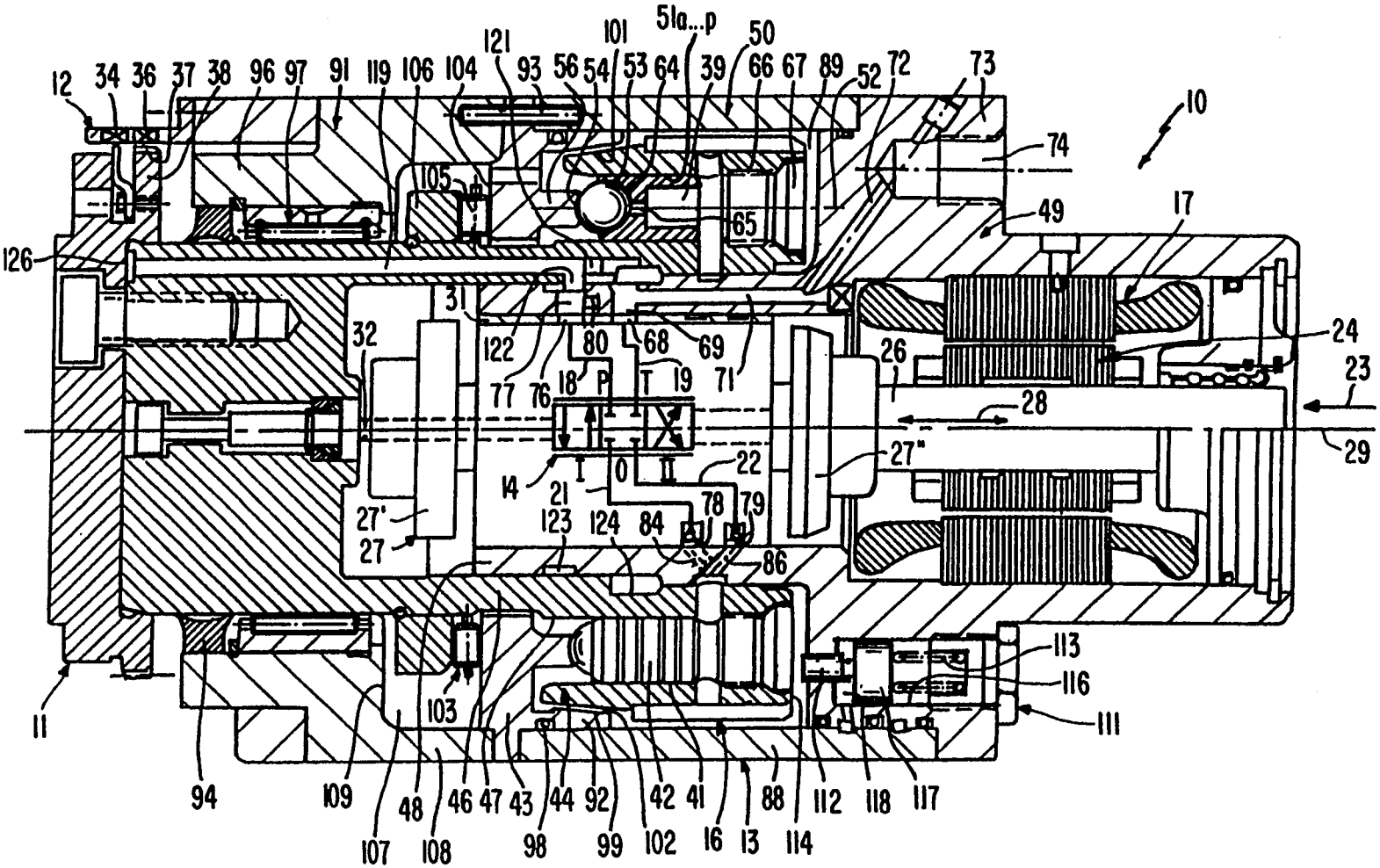
FIG. 1 is a schematic cross-sectional view of a drive according to the invention with a follow-up control valve accommodated by the output shaft of an axial-piston hydraulic motor provided as the power drive unit.

Modern pickup systems 12 of the type here under consideration make it possible to handle angular resolutions of 0.01° or less.

In particular, the drive 10 is intended for use within the scope of CNC (computer numeric control) controlled machine tools or within the framework of robots or manipulators or machinery comparable thereto exhibiting multiple-jointed outriggers or "arms" carrying at their free end either a gripper or a tool which latter must be guidable along an exactly defined motion route and/or must be placeable into a certain position determined by the indication of coordinate values. In this latter case, it is not absolutely necessary for this position to be attained along a specific path, in any event in case this position is only a starting point for a movement of the tool or gripper from which on only an exactly defined route is to be maintained.

The drive 10 comprises, as the power drive means, a hydraulic motor 13 designed as an axial-piston motor, and, as the control element, a follow-up control valve 14 which operates with electrically controllable rotary angle desired value presetting and with mechanical actual value acknowledgment of the instantaneous angular position of the rotor 16, of the hydraulic motor 13 and thus also of the output element 11 thereof. For the purpose of feeding an incremental rotary angle desired value or a desired position value, an electric motor 17 is included and designed as a pulse-controlled stepping motor or also realizable as an AC motor. With respect to its function, it is to be regarded; in turn, as a control element of the follow-up control valve 14.

For this follow-up control valve 14, illustrated in FIG. 1 essentially by its hydraulic switching symbol, the structural design is utilized as known in detail from DE 3,729,564 A1, the content of the latter being referred to in regard to this feature. Therefore, the valve will be described below only with respect to its function within the scope of the drive 10, and structural details will be discussed in greater detail only insofar as necessary for the explanation of the specific embodiment.

The follow-up control valve 14 is designed as a 4/3-way valve wherein the neutral basic position 0 associated with the standstill of the hydraulic motor 13 is a blocking position wherein the P supply connection 18 of the hydraulic motor 13 via which the latter is connected to the high-pressure outlet of a pressure supply system, not shown, and the T supply connection 19 via which the hydraulic motor 13 is connected to the pressureless storage tank of the pressure supply system, i.e. with the storage tank being maintained at atmospheric pressure, are blocked off against the control connection 21 as well as against the B control connection 22 of the hydraulic motor 13, by which the rotary drive direction of the hydraulic motor 13 can be controlled with alternative connection to the P supply connection 18 and the T supply connection 19.

From the basic position 0, the follow-up control valve 14 can be regulated, in correspondence with the alternative directions of rotation wherein the electric motor 17 can be electrically activated, either to assume the functional position I wherein the P supply connection 18 is connected to the A control connection 21 and the T supply connection 19 is connected to the control connection 22 of the hydraulic motor 13, or to assume the functional position II wherein the P supply connection 18 is connected to the control connection 22 and the T supply connection is connected to the control connection 21 of the hydraulic motor 13.

It is to be assumed, for the illustrated embodiment, that the activation of the follow-up control valve 14 into its functional position I in the direction of the arrow 23 takes place by driving the electric motor 17, in a clockwise direction and accordingly the follow-up control valve 14 is activated to assume its functional position II when the electric motor 17 rotates in the counterclockwise direction. Furthermore, it is presupposed for the illustrated embodiment that the direction of rotation of the hydraulic motor 13 is of the same sense as that of the electric motor 17.

The presetting of the desired values for the rotary angle and, respectively, for the position takes place, as indicated merely schematically in FIG. 1, by way of a desired value presetting shaft 26 nonrotationally connected to tile rotor 24 of the electric motor 17. By rotation of the shaft 26, a valve operating element 27, can be displaced in dependents upon the direction of rotation of the rotor 24 of the electric motor 17, in the clockwise direction or in the counter-clockwise direction, in the alternative directions marked by the double arrow 28. A valve member of the follow-up control valve 14 presumed to be fashioned as a slide is, so to speak, "clamped in place" between control flanges 27' and 27'' of the valve operating element 27 as seen in the direction of the central longitudinal axis 29 of the drive 10, and accordingly participates in the displacement motions of the valve operating element 27. This valve operating element 27 is designed, in the construction known from DE 2,729,564 A1, as a threaded nut coaxially encompassing the desired value presetting shaft 26 at least along longitudinal sections thereof and being guided in the housing 31 of the follow-up control valve 14 to be longitudinally movable, but nonrotational. This threaded nut meshes via threaded balls with an outer thread of the desired value presetting shaft 26, which is not separately illustrated. For actual position value acknowledgment, the follow-up control valve 14 includes a threaded spindle 32 as the "acknowledgment spindle" which meshes with an internal thread of the desired value presetting shaft 26. The threaded spindle 32 is nonrotationally coupled with the rotor 16 of the hydraulic motor 13.

Moreover, the drive control circuit is closed from the actual value side to the desired value side by the incremental path or rotary position pickup system 12 comprising a first pickup 34 detecting the number of revolutions executed by the rotor 16 of the hydraulic motor 13 and a second or incremental pickup 36 breaking up each of these revolutions into a number of angular increments.

This incremental pickup 36 is realized in a manner not shown, by two pickup elements arranged as viewed in the circumferential direction of a peripheral serration 37 of a pickup disk 38 revolving with the rotor 16 of the hydraulic motor 13 in mutually staggered relationship in such a way that pulse-shaped or sinusoidal electrical output signals of these pickup elements have a mutual phase shift of 90° so that, in addition to the amount of positional changes, it is also possible to derive the direction of rotation of the rotor 16 of the hydraulic motor 13 from the signal levels and the phase position of the output signals of the pickup elements. The pickups 34 and 36 can be realized with the aid of field plates or as inductive, optionally also capacitive or electrooptic pickups of a structure known per se.

Also the hydraulic motor 13 is known in its structural principle insofar as the translation of axial movements of piston elements 42, movably defining the drive chambers 39 of a plurality of "small" linear cylinders 41, into rotational movements of the rotor 16 by axial support of these piston elements 42 on a supporting disk 43 of the axial-piston hydraulic motor 13, fixedly mounted to the housing and of "corrugated" shape on its side facing the linear cylinders 41, corresponds to the prevalent state of the art.

A hydraulic axial-piston motor corresponding to this structural principle which, as also provided in the embodiment according to FIG. 1, is activated by a follow-up control valve as described in detail in German Patent Application P 38 27 365.9; as a supplement, reference is had to the description of this reference with regard to the design of the drive section 44 of the rotor 16 of the hydraulic motor 13 and with respect to the cooperation between this hydraulic motor and the follow-up control valve 14. Accordingly, the following description of the specific embodiment of the drive 10 according to this invention as illustrated in the drawing will be limited in to its differences existing as compared with the drive mechanism according to the aforementioned patent application.

The rotor 16 of the axial-piston hydraulic motor 13 is supported to be slidingly rotatable, with a substantially circular-cylindrical-tubular section 46 of its output shaft 47, on a tubular pivot pin 48 which latter, in turn, is of a substantially circular-cylindrical-tubular shape. This pivot pin forms an axial extension of a part 49 of the housing 50, of the drive 10 with the part 49 accommodating the electric motor 17. This tubular pivot pin 48 has fixedly inserted therein the housing 31, cylindrical-tubular in shape, in turn, of the follow-up control valve 14 and is encompassed by the pivot pin 48 along its entire length.

The drive section 44 of the rotor 16, forming a joint housing for the small linear cylinders 41, is fashioned as a radial flange designed integrally with the output shaft 47 of the rotor and being relatively thick-walled as viewed in the axial direction in accordance with the illustration of FIG. 1. As can be seen best from the schematic illustration of FIG. 2, a total of sixteen bores 51*a* to 51*p* continuously extending in the axial direction are worked into this flange and are grouped, with an axially symmetrical distribution of their central longitudinal axes 52, about the central longitudinal axis 29 of the drive 10. The piston elements 42, sealed with respect to the bore faces, are arranged in slidingly displaceable fashion in these bores 51*a* to 51*p*. These piston elements are supported by way of balls 53 on the axially opposite end face 54, curved concavely approximately complementarily to the balls and pertaining to an annular rib 56 of the supporting disk 43 which latter is fixedly mounted to the housing. This annular rib 56, the average diameter of which corresponds to that of the bore circle of the axial bores 51*a* to 51*p*, has, as seen in the circumferential direction, a "height" varying periodically in the axial direction in such a way that there results for this end face 54, as seen in the developmental view of FIG. 2, a configuration which, in total, has the shape of a triangular wave with a "length of periodicity" $\theta p$ of 60° as measured in angular degrees, i.e. a six-numbered axial symmetry. The annular rib 56 thus exhibits in total the shape of a "six-point" crown, the points 57*a* to 57*f* of which are arranged pointing toward the drive section 44 of the rotor 16. In the developmental representation of FIG. 2, the points 57*a* to 57*f* of the annular rib 56, which latter is of circular-ring shape at its base 58, have the configuration of flat obtuse-angled isosceles triangles, the legs 59*a* to 59*f* and 61*a* to 61*f* of which form an obtuse angle $\beta$ which, under practical conditions, has a value around 140°, in a preferred embodiment of the axial-piston motor 13 a value of 138°.

Between the "apices" 62*a* to 62*f* of the points 57*a* to 57*f* and the interposed "valleys" 63*a* to 63*f* of the annular rib, alternatingly rising and falling ramps of constant slope or inclination are formed by the legs 59*a* to 59*f* and 61*a* to 61*f*, these ramps adjoining one another with a smooth curvature at the apices and in the valleys. The radius of curvature with which respectively two flanks adjoin each other in the valleys 63*a* to 63*f* is somewhat larger than the spherical radius of the supporting balls 53.

The supporting balls 53, forming together with the piston elements 42 of a cylindrical-cup shape the pistons of the linear cylinders 41 defining unilaterally in a pressure-tight movable fashion the drive chambers 39 of the in total 16 linear cylinders 41, are supported in concave bearing seats 64 of the piston elements 42 in freely rotatable fashion so that they can readily roll along the race surface 54 of the annular rib 56. The bearing seats 64, the curvature of which is adapted very accurately to that of the supporting balls 53, are in communicating connection, via central lubricating ducts 65, with the drive chambers 39 of the linear cylinders 41 so that a thin lubricant film can form during operation of the axial-piston motor 13 between the sliding surfaces of the bearing seats 64 and the supporting balls 53, ensuring an extensively wear-proof operation of the axial-piston motor 13.

The rotor-fixed axial boundaries of the drive chambers 39 of the linear cylinders 41 are constituted by plugs 67 threadable into threaded sections 66 of the bores 51*a* to 51*p* of the drive section 44 and providing a unilateral, tight seal for these bores 51*a* to 51*p*. The T supply connection 19 of the follow-up control valve 14 is in communication, via a radial bore 68 of the housing 31 of the follow-up control valve 14, with a radial bore 69 of the pivot pin 48 in alignment with the radial bore 68 and penetrating the cylindrical wall of the pin. A longitudinal channel 71 terminates in this transverse bore 69 and is connected, in turn, in communicating fashion with the T connection nipple 74 by way of a sloping bore 72 arranged in a solid, outer radial flange 73 of the housing section 49 accommodating the electric motor 17. The nipple can be connected to the pressure-less tank of the pressure supply unit by way of hose conduits or pipelines, not illustrated. The P supply connection 18 of the follow-up control valve 14 is in communication, via a further transverse bore 76 of the outer casing of the valve housing 31, with a second radial bore 77 of the pivot pin 48, in alignment with this bore 76. A longitudinal channel 80 terminates, in turn, into this bore 77 and passes, as seen in the direction of the central longitudinal axis 29, at an azimuthal spacing by the longitudinal channel 71 leading to the tank connecting nipple 74. This longitudinal channel likewise leads, via an inclined bore (not shown) to the P connecting nipple, not shown, which is connected to the high-pressure outlet of the pressure supply unit. The A control connection 21 of the follow-up control valve 14 is in communication with an outer groove 78 of the valve housing 31 fashioned as an annular fluting surrounding this housing as shown in FIG. 2 as a pressure medium channel 78 extending over the entire length of the development.

Figure 2:
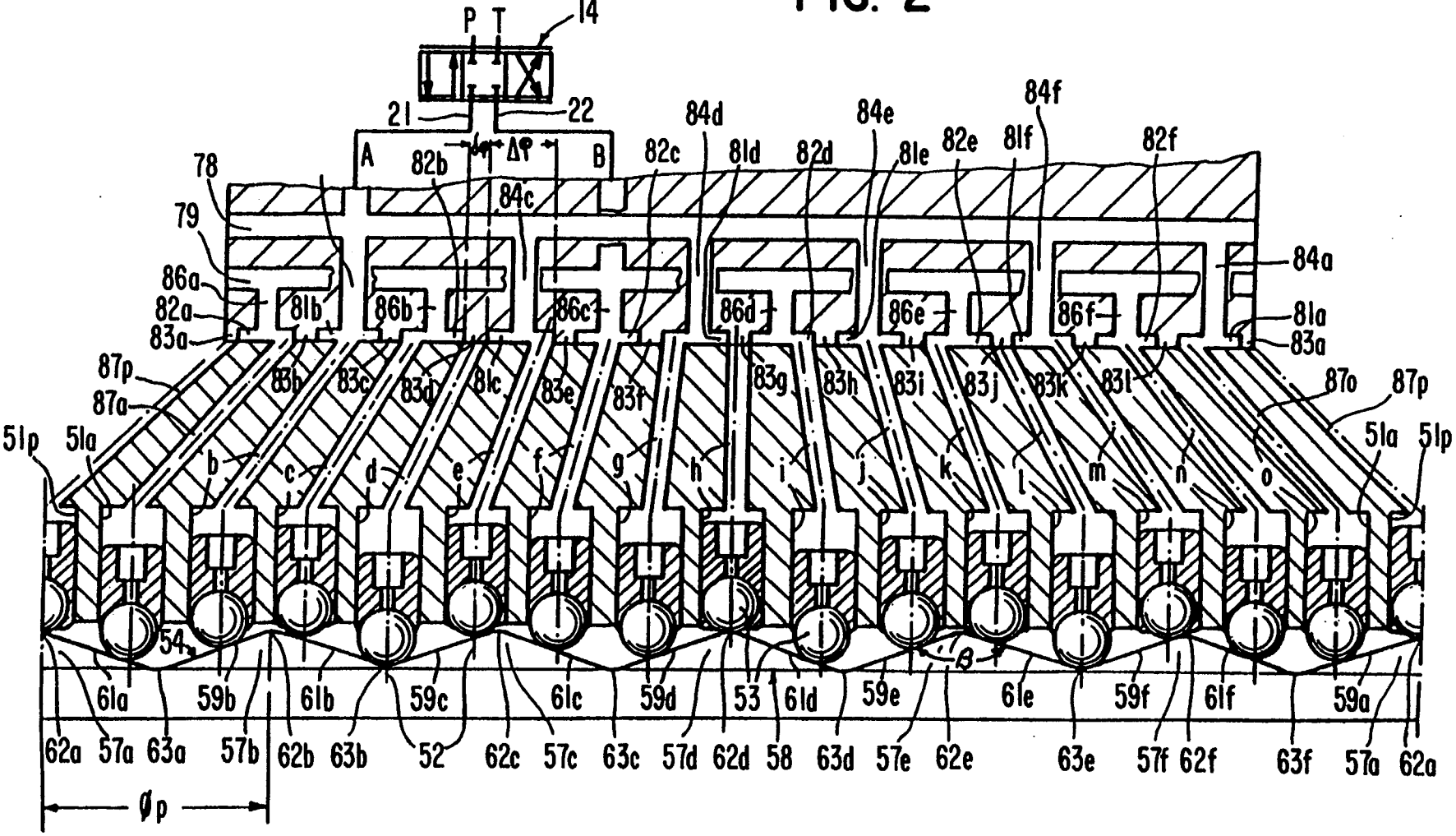
FIG. 2 is a schematic cross-sectional view of a drive section of the of the hydraulic motor of FIG. 1.

Also, the control connection 22 of the follow-up control valve 14 is in communicating connection with a second outer groove 79, likewise formed as an inherently closed annular groove extending over the entire circumference of the valve housing 31 and correspondingly shown in FIG. 2 as a pressure medium channel extending over the entire length of the developmental illustration.

Outer grooves 81*a* to 81*f* as well as 82*a* to 82*f* are provided on the outside of the pivot pin 48 lying in opposition to the two annular grooves 78 and 79, grouped in a number of, in total, twelve in axially symmetrical arrangement about the central longitudinal axis 29 and having the shape of sectors as seen in the peripheral direction. These outer grooves are in each case offset from one another by axial intermediate webs 83*a* to 831. These outer grooves 81*a* to 81*f* as well as 82*a* to 82*f* are connected, as seen in the peripheral direction as can best be seen from FIG. 2, in alternating arrangement via the substantially radially extending bores 84*a* to 84*f* to the annular groove 28, which latter is in communication with the control connection 21 of the follow-up control valve 14, or, respectively, via transverse bores 86*a* to 86*f*, to the annular groove 79 of the valve housing 31 in communication with the B control connection 22 of the follow-up control valve 14.

The angular width of the sector-shaped outer grooves 81*a* to 81*f* and, respectively, 82*a* to 82*f*, measured in the circumferential direction, plus the correspondingly measured angular width of one of the axial webs 83*a* to 831 offsetting respectively two of these grooves, e.g. grooves 82*b* and 81*b*, is in its sum total 30°. The angular width of the sector-shaped grooves 81*a* to 81*f* and 82*a* to 82*f* is substantially larger, the ratio of $\delta\Phi/\delta\Phi$ of 5 and 10. The angular width of the webs 83*a* to 83*p* corresponds to the azimuthal width, i.e. the inside width measured in the peripheral direction, of radial through bores 87*a* to 87*p* of the circular-cylindrical-tubular section 46 of the rotor 16 of the hydraulic motor 13. By way of these through bores, the drive chambers 39 of the linear cylinders 41 enter, while the rotor is turning, in alternating fashion into communicating connection with the A control connection 21 and the B control connection 22 of the follow-up control valve 14 and are blocked entirely for a brief instant while passing one of the webs 83*a* to 83*p*.

Based on the aforedescribed symmetry relationships, the linear cylinders connected "simultaneously" to one of the two annular grooves 78 and 79, contribute in each case in the same direction toward torque buildup of the axial-piston motor 13 or, alternatively, do not participate therein. It can be seen directly from FIG. 2 that, in the specific embodiment, respectively at least six of the linear cylinders and, in the extreme case, even eight contribute in the same direction toward torque buildup.

For the sake of completeness, it should also be noted that, in FIG. 1, reference numerals provided with alphabetical indices in FIG. 2 are shown without these indices for the sake of simplicity.

By virtue of the structural integration, as described thus far, of the follow-up control valve 14 into the pivot pin 48 of the housing section 49, shortest possible dimensions result for the pressure supply channels 84*a* to 84*f* and 86*a* to 86*f*, as well as for the radial channels 87*a* to 87*p*, leading from the follow-up control valve 14 to the drive chambers 39 of the linear cylinders 41; this is of great importance for a high "rigidity" of the drive.

The supporting disk 43 provided with the wavy annular rib 56 is clamped in place axially between a cylindrical-tubular housing section 88 sealed with respect to the radial flange 73 of the housing section 49 accommodating the electric motor 17 and forming essentially the radial, outer boundary of the annular chamber 89 accommodating the drive section 44 of the rotor 16, and a cylindrical end section 91, staggered on the outside and inside, of the housing 50 of the drive 10. The supporting disk 43 is accurately centered, by means of a centering ring 92 integral with this disk, the outer diameter of this ring corresponding exactly to the inner diameter of the cylindrical-tubular housing section 88, with respect to this housing section and, respectively, the central longitudinal axis 29 of the drive 10, and is secured against rotations relatively to the housing sections 88 and 91 by an axial fitting pin 93 penetrating a bore of the supporting disk 43 which latter bore is in alignment with coaxial bores of the cylindrical-tubular housing section 88 and of the housing end section 91. The stepped end section 91 of the housing 50 from which the rotor 16 exits with the end portion, forming the output part 11, of a rotor shaft 47 solid at that point, is sealed with respect to this shaft by means of a annular lip gasket 94.

Within the outer step 96 of the staggered-cylindrical housing section 91, which step is on the output side and is smaller in its internal diameter, the rotor shaft 47 is rotatably supported by means of a radial needle bearing 97, this needle bearing 97, just as the "pivot pin bearing", permitting an axial movability of the rotor 16. The centering ring 92 of the supporting disk 43, in contact radially on the outside with a cylindrical surface against the cylindrical inner surface of the cylindrical-tubular housing section 88 and being sealed with respect to this housing section 88 by means of an annular gasket 98, has on its radially inner side a conical chamfered surface 99, the inside diameter of which increases toward the drive section 44 of the rotor 16. The drive section 44 of the rotor 16 is, in turn, provided with an outer chamfered surface 101 lying in opposition to the chamfered surface 99 of the centering ring 92 of the supporting disk 43 as seen in the axial direction. The inclination of this surface 101 with respect to the central longitudinal axis 29 of the drive 10 corresponds to that of the chamfered surface 99 of the centering ring 92 pertaining to the supporting disk 43.

In the position of rotor 16 illustrated in FIG. 1, corresponding to a rotational operating condition of the axial-piston hydraulic motor 13, the two chamfered surfaces 99 and 101 of the supporting disk 43 and of the drive section 44 of the rotor 16, as seen at the "level" of a joint value of their diameters, are arranged at a small axial spacing of, for example, 1–2 mm from each other. Thus, a conical gap 101 remains between the two chamfered surfaces with an inside width as measured perpendicularly to the chamfered surfaces 99 and 102 of several tenths of a millimeter. This position of the rotor 16 with respect to the supporting disk 43 is determined by the contact of bearing rollers 105 of an axial roller bearing 103 against the annular surface 104 thereof lying in opposition to the annular rib 56 of the supporting disk 43. The support thereof lying in opposition to this annular surface 104 includes a bearing ring 106 nondisplaceably connected to the rotor shaft 47. The axial roller bearing 103 formed by the bearing rollers 102 and the bearing ring 106 is arranged within an annular chamber 107, the outer radial boundary of which is formed by the step 108 of the stepped housing section 91 which is of a larger inner diameter. In the axial direction, this annular chamber 107 is defined by the annular shoulder 109 forming the intermediary between the two housing steps 96 and 108, and by the supporting disk 43. The inside axial distance between the bearing ring 106 and the annular shoulder 109 of the stepped housing section 91 is somewhat larger than the inside axial distance of the two chamfered surfaces 99 and 101 or the centering ring 92 of the supporting disk 43 and of the drive section 44 of the rotor 16, as seen in the illustrated operating position of the axial-piston hydraulic motor 13 into which its rotor 16 is urged by the exposure to pressure from respectively at least 6 drive chambers 39 of its linear cylinders 41.

In order to prevent "uncontrolled collapse" of the robot arm when using the drive 10 for a robot arm, for example, which comprises as the "joints" several drive mechanisms 10, the drive 10 is equipped with a locking device 111. This locking device, upon cutoff of the drive 10, automatically brings about arresting of the rotor 16 in the annular position assumed at the instant of cutoff.

In the illustrated embodiment, plungers 112, arranged in axially symmetrical grouping about the central longitudinal axis 29 of the drive 10, are provided as activators of the "locking brake 111". These plungers can be urged by pretensioned compression springs 113 into contact with the annular end face 114 which faces away from the supporting disk 43—rearward one—of the drive section 44 of the rotor 16. As a result, the rotor 16 experiences axial displacement by means of which the two chamfered surfaces 99 and 101 of the centering ring 92 and of the drive section 44, acting in this case as friction surfaces of the locking device 111, come into contact with each other, thus achieving a friction-evoked fixation of the rotor 16 in the housing 50 of the drive 10. The plungers 112 are connected to pistons 117 which can be displaced, in pressure-sealed fashion, in axial bores 116 of a larger diameter. The pretensioned compression springs 113 engage on the sides of these pistons facing away from the plungers 112. These pistons 117 also form the axially movable boundaries of control chambers 118 into which, during operation of the drive 10, the high outlet pressure of the auxiliary pressure source is coupled. Thereby, the pistons 117 and therewith the plungers 112 are urged into a position illustrated in FIG. 1, removed from the drive section 44 of the rotor 16 and/or lifted off the latter. In this position, the locking device 111 is released and the rotor 16 in its illustrated axial position is freely rotatable.

The small axial displaceability of the rotor 16 required for obtaining the locking function in the illustrated embodiment can be realized without difficulties in the described structure of its bearing, radially inwardly at the pivot pin 48 of the housing section 49 accommodating the electric motor 17, and radially outwardly by means of the needle bearing 97 at the housing end section 91.

For usages of the drive mechanism 10 wherein the displaceability of the rotor 16, required for the locking device 111 described thus far, would not be advantageous, an analogously acting locking device can also be realized in such a way that a brake shoe having the shape of an annular disk and being connected fixedly with respect to tension and thrust to the plungers 112 is provided which can be urged into contact with the rearward end face 114 of the drive section which latter then acts, in turn, as the brake shoe. In this arrangement, the rotor 16 can be rotatably mounted in the housing 50 to be fixed against axial displacement.

An axial movability of the acknowledgment spindle 32 with respect to the rotor shaft 47 of the axial-piston motor 13, required for the function of the follow-up control valve 14, can be realized, as not shown in detail, by the feature that the acknowledgment spindle 32 is coupled via an axial serration with the rotor shaft 47 to be fixed against rotation but to be axially movable.

The further extension of the supply connections of the pressure supply unit, shown in FIG. 1 by the P supply connection 18 and the T supply connection 19 of the follow-up control valve 14 of the drive 10 to a further drive of the same type, attachable to the output section 11 of the drive 10, takes place via longitudinal channels 119 and 121 of the rotor shaft 47, extending at an azimuthal distance from each other as seen in the direction of the central longitudinal axis 29 of the drive 10, wherein one longitudinal channel 119 associated in the illustrated specific embodiment with the P supply connection 18 of the follow-up control valve 14 is in permanent communication via a short transverse channel 122 with an outer annular groove 123 of the pivot pin 48 wherein the high outlet pressure P of the pressure supply unit is ambient, whereas the other longitudinal channel 121 associated with the T supply connection 19 of the follow-up control valve 14 in the shown drive mechanism 10 is in communication with an inner annular groove 124 provided at the rotor shaft 47. The inside cross section of this last-mentioned groove overlaps permanently with that of the radial transverse bore 69 of the pivot pin 48 connected via the longitudinal channel 71 of this pin and the inclined bore 72 with the T supply nipple 74 of the drive 10.

Due to the feature that the outer groove 123 of the pivot pin 48, conducting in the illustrated embodiment the P supply pressure, is arranged at a smaller axial spacing from the terminating plane 126 of the longitudinal channel 119 with which the groove is in communication than the inner groove 124 of the rotor with which its other longitudinal channel 121 communicates, it is possible to extend these two longitudinal channels 119 and 121 at the same radial distance from the central longitudinal axis 29 of the drive 10 and to make do with minimal radial cross-sectional dimensions of the annular-cylindrical section 46 of the rotor shaft 47.

I claim:

1. A hydraulic drive fashioned as one of a rotary or swivel device for NC or CNC controlled machine tools, feeding devices of such machine, manipulators, or robots with several rotary or swivel joints, the hydraulic drive comprising:

an axial-piston hydraulic motor forming a power drive;

a follow-up control valve for controlling a pressure medium supply with an electrically controlled desired position value presetting and mechanical actual position value acknowledgement;

an electric motor provided for the electrically controlled desired position value presetting, said electric motor being be activatable by output signals of a central NC or CNC control unit wherein a rotor of the axial-piston hydraulic motor is rotatably supported by a circular-cylindrical-tubular section of an output shaft thereof on an outer casing surface of an axial extension, the axial-extension being fashioned in a hollow tubular-shape and forming a pivot pin for the rotor of a housing section having said electric motor provided for the desired value presetting with the follow-up control valve being a pivot pin for the rotor of a housing section containing the electric motor;

control channels which during operation of the hydraulic drive couple a pressure medium alternately fed and discharged through control connections of the follow-up control valve to and from linear cylinders of the rotor arranged in sequence as viewed in a circumferential direction of the rotor, said control channels are formed as sector-shaped outer grooves of the pivot pin and radial transverse channels of the rotor lead to drive channels of the linear cylinders of the rotor; and supply connections of the follow-up control valve connected to transverse bores of a housing of the follow-up control valve, with the transverse bores terminating in transverse channels of the pivot pin which, as viewed in the circumferential direction of the valve housing are arranged in an offset fashion and are connected by way of correspondingly offset longitudinal channels with connecting nipples arranged at the housing section forming the pivot pin with one of the transverse channels terminating into an inner groove of the circular-cylindrical tubular section of the rotor shaft of the axial-piston hydraulic motor which the circular-cylindrical tubular surrounds the pivot pin and an other of the transverse channel terminating into an outer groove of the pivot pin, a transverse channel of the rotor shaft ending in the outer groove and being located between the inner groove and an end of the rotor shaft on an output side, and one supply connection channel extended from the inner groove of the rotor shaft and the transverse channel to the end of the rotor shaft on the output side.

2. A drive according to claim 1, wherein:

a pickup system is provided producing electrical output signals representative of incremental changes of an angular position of the rotor of the axial-piston hydraulic motor in accordance with an amount and change of direction with an electronic control unit providing a position value.

3. A drive according to one of claims 1 or 2, further comprising:

a locking device responsive to a drop in outlet pressure of a pressure supply unit, stops of the rotor of the axial-position hydraulic motor.

4. A drive according to claim 3, wherein:

spring-loaded plungers are urged, by a pretensioned spring, into a position which stops the rotor and are connected with pistons defining pressure-tight movable control chambers with the plungers having a release position for freeing the rotor by exposing the control chambers to outlet pressure of the pressure supply unit.

5. A drive according to claim 4, wherein:

a plurality of plungers are arranged in an axially symmetrical grouping around a central longitudinal axis of a drive with the plungers being displaceable in parallel along the central longitudinal axis of the drive and acting on an axially movable brake element.

6. A drive according to claim 5, wherein:

the rotor of the axial-position hydraulic motor is supported to be axially displaceable with a brake surface extending over 360° into frictional contact with a counter surface.

7. A drive according to claim 6, wherein:

the brake surface of the rotor has a conical peripheral chamfer of a drive section containing the linear cylinders with the chamfer being located on a side of the drive section facing a supporting disk with the counter surface having a conical chamfer of a centering ring of the supporting disk.

8. A drive according to claim 7, wherein:

the rotor viewed from the drive section beyond the supporting disk carries a radial bearing ring of an axial roller bearing with rollers of the bearing rolling along a radially planar, circular-ring-shaped counter surface provided at the supporting disk.

9. A drive according to one of claim 6, wherein:

the rotor of the axial-piston hydraulic motor is supported with an end section of the rotor shaft forming the output section with a needle bearing rotatable and axially displaceable at the housing section on an output side of a housing of the drive.

* * * * *